US008417457B2

(12) United States Patent
Franquet

(10) Patent No.: US 8,417,457 B2
(45) Date of Patent: Apr. 9, 2013

(54) BOREHOLE STRESS MODULE AND METHODS FOR USE

(75) Inventor: Javier Alejandro Franquet, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 53 days.

(21) Appl. No.: 12/831,538

(22) Filed: Jul. 7, 2010

(65) Prior Publication Data

US 2011/0010097 A1 Jan. 13, 2011

Related U.S. Application Data

(60) Provisional application No. 61/223,976, filed on Jul. 8, 2009.

(51) Int. Cl.

| | |
|---|---|
| ***G01V 9/00*** | (2006.01) |
| ***G06F 19/00*** | (2011.01) |
| ***G06F 17/40*** | (2006.01) |

(52) U.S. Cl.

USPC ..... 702/11; 73/152.59; 73/784; 166/250.01; 166/305.1; 175/50; 702/42; 702/189

(58) Field of Classification Search ..... 73/11.01, 73/12.01, 12.08, 152.01, 152.02, 152.05, 73/152.54, 152.57, 152.59, 432.1, 760, 784, 73/865.8, 866; 166/244.1, 250.01, 250.1, 166/297, 298, 305.1, 307, 308.1; 175/40, 175/50; 250/253, 256, 268; 702/1, 2, 6, 702/11, 33, 41, 42, 127, 182, 187, 189; 703/6, 703/9, 10

See application file for complete search history.

(56) References Cited

U.S. PATENT DOCUMENTS

| | | | | |
|---|---|---|---|---|
| 3,527,302 | A * | 9/1970 | Broussard | 166/297 |
| 3,960,448 | A | 6/1976 | Schmidt et al. | |
| 3,961,524 | A | 6/1976 | De La Cruz | |
| 3,969,929 | A | 7/1976 | Shaw et al. | |
| 3,992,095 | A | 11/1976 | Jacoby et al. | |
| 4,149,409 | A | 4/1979 | Serata | |
| 4,461,171 | A | 7/1984 | De La Cruz | |
| 4,491,022 | A | 1/1985 | De La Cruz | |
| 4,590,995 | A | 5/1986 | Evans | |

(Continued)

FOREIGN PATENT DOCUMENTS

GB 2441904 A * 3/2008

OTHER PUBLICATIONS

Cornet, F. et al., "Complete Stress Determination with the HTPF Tool in a Mountainous Region," Int. J. Rock Mech. & Min. Sci. 34:3-4, paper No. 057; 1997 Elsevier Science Ltd.

(Continued)

*Primary Examiner* — Edward Cosimano
(74) *Attorney, Agent, or Firm* — Mossman, Kumar & Tyler, PC

(57) ABSTRACT

The disclosure is directed to methods and apparatuses for estimating a response relating to a formation by stressing a wall of a borehole during either wireline or while drilling deployment. The response may be estimated by stressing the wall of a borehole formed in the formation; and estimating a response of the borehole wall to the stress. The response may be estimated using a force module configured to induce the stress around borehole and a tool configured to estimate the response of the borehole wall to the stress.

20 Claims, 7 Drawing Sheets

U.S. PATENT DOCUMENTS

| | | | | |
|---|---|---|---|---|
| 4,599,904 | A * | 7/1986 | Fontenot | 73/783 |
| 5,050,690 | A | 9/1991 | Smith | |
| 5,105,881 | A | 4/1992 | Thoms et al. | |
| 5,236,040 | A | 8/1993 | Venditto et al. | |
| 5,361,836 | A | 11/1994 | Sorem et al. | |
| 5,576,485 | A | 11/1996 | Serata | |
| 5,743,334 | A * | 4/1998 | Nelson | 166/250.07 |
| 5,967,232 | A * | 10/1999 | Rhett | 166/250.1 |
| 6,021,676 | A | 2/2000 | Yamauchi | |
| 6,176,313 | B1 * | 1/2001 | Coenen et al. | 166/280.1 |
| 6,285,026 | B1 | 9/2001 | Evans et al. | |
| 6,904,365 | B2 | 6/2005 | Bratton et al. | |
| 7,660,197 | B2 | 2/2010 | Barolak | |
| 7,828,063 | B2 | 11/2010 | Olsen et al. | |
| 2004/0176911 | A1 * | 9/2004 | Bratton et al. | 702/6 |
| 2004/0237640 | A1 * | 12/2004 | Meister et al. | 73/152.48 |
| 2008/0170467 | A1 * | 7/2008 | Barolak | 367/35 |
| 2009/0164124 | A1 | 6/2009 | Ryan et al. | |
| 2009/0254280 | A1 | 10/2009 | Stoesz | |

OTHER PUBLICATIONS

Thiercelin, M. et al., "A New Wireline Tool for In-Situ Stress Measurements," SPE 25906: SPE Formation Evaluation, Mar. 1996.

Desroches, J et al., "Applications of Wireline Stress Measurements," SPE 58086: SPE Reservoir Evaluation & Eng. 2(5), Oct. 1999.

* cited by examiner

BOREHOLE STRESS MODULE AND METHODS FOR USE

CROSS-REFERENCES TO RELATED APPLICATIONS

This application claims priority from expired U.S. Provisional Patent Application Ser. No. 61/223,976 filed on 8 Jul. 2009.

BACKGROUND OF THE DISCLOSURE

1. Field of Disclosure

In aspects, the present disclosure relates to characterizing underground formations and/or features. In further aspects, the present disclosure relates to methods and devices for measuring borehole and/or formation characteristics while inducing a stress on the borehole wall.

2. Description of the Related Art

Wells, tunnels, and other similar holes formed in the earth may be used to access geothermal sources, water, hydrocarbons, minerals, etc. and may also be used to provide conduits or passages for equipment such as pipelines. This hole is commonly referred to as a borehole or wellbore of a well and any point within the borehole is generally referred to as being downhole. Boreholes are commonly used in significant capital commercial developments, such as hydrocarbon fields. Therefore, before field development begins, operators desire to have as much information as possible in order to evaluate the reservoir for commercial viability. Such information may be acquired at the seismic exploration phase, during well construction, prior to well completion and/or any time thereafter. A vast amount of the information used for characterizing reservoirs is based directly or indirectly on measurements made in a borehole traversing a hydrocarbon reservoir of interest.

In aspects, the present disclosure is directed to devices, systems and method that may be utilized to obtain or improve information that may be used for characterizing a formation and/or a borehole intersecting such formation.

SUMMARY OF THE DISCLOSURE

The present disclosure is directed to method and apparatus for determining borehole deformation characteristics by performing downhole measurements while inducing stresses around a borehole.

An embodiment of the disclosure includes a method for estimating a response relating to a formation, comprising: stressing a wall of a borehole formed in the formation; and estimating a response of the borehole wall to the stress.

Another embodiment of the disclosure includes an apparatus for estimating at least one parameter of interest relating to a formation, comprising: a force module configured to stress a wall of a borehole formed in the formation; and a tool configured to estimate a response of the borehole wall to the stress.

The above-recited examples of features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
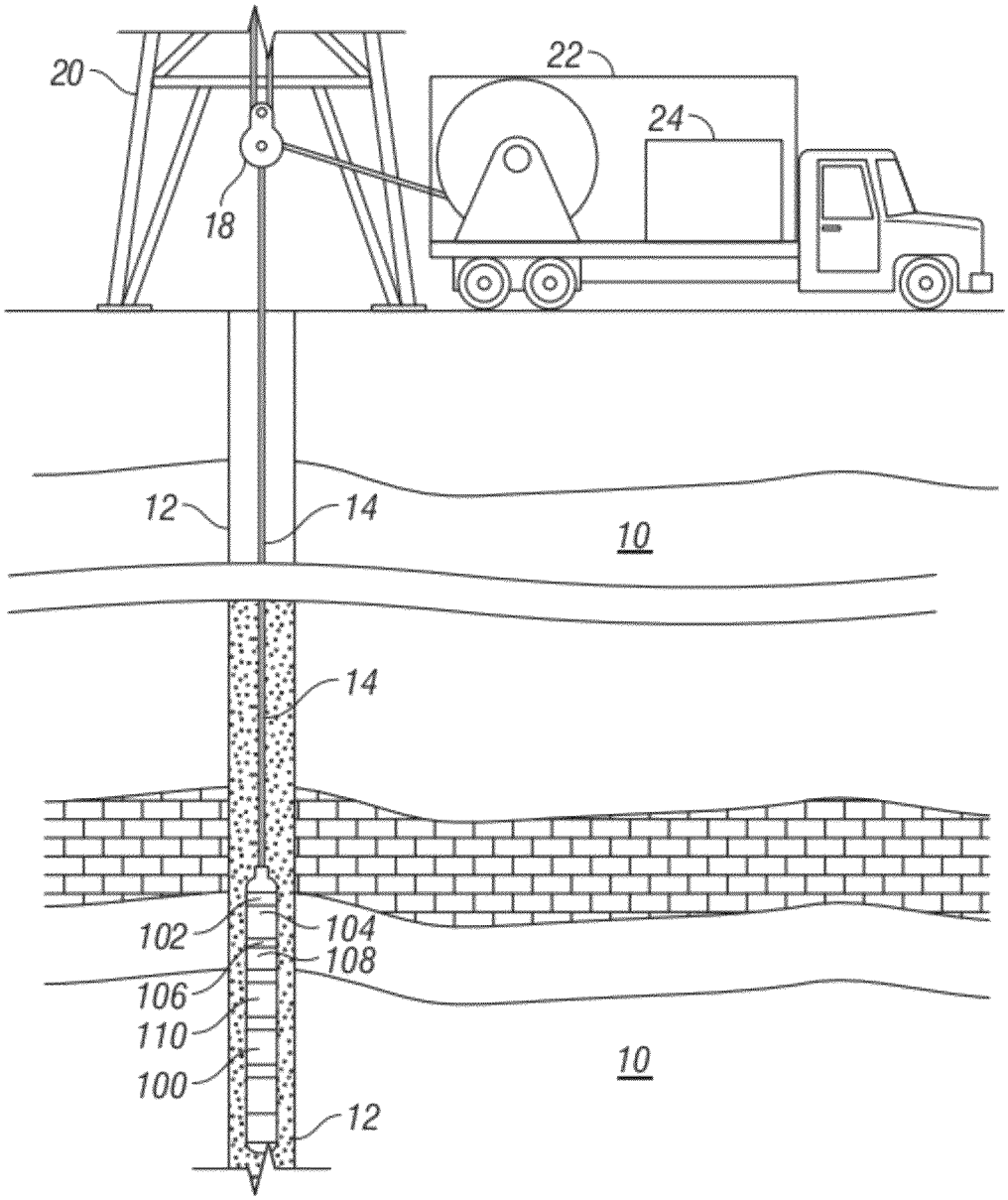
FIG. 1 illustrates a tool in accordance with one embodiment of the present disclosure that is deployed via a non-rigid carrier.

The present disclosure relates to devices and methods for obtaining information relating to subterranean formations. The present disclosure is susceptible to embodiments of different forms. There are shown in the drawings, and herein will be described in detail, specific embodiments of the present disclosure with the understanding that the present disclosure is to be considered an exemplification of the principles described herein, and is not intended to limit the disclosure to that illustrated and described herein. Indeed, as will become apparent, the teachings of the present disclosure can be utilized for a variety of well tools and in all phases of well construction and production. Accordingly, the embodiments discussed below are merely illustrative of the applications of the present disclosure.

In aspects, the teachings of the present disclosure may be used to estimate, evaluate or otherwise characterize formation mechanical properties and in-situ stresses. Certain embodiments of the present disclosure may obtain information used for such purposes by deforming a borehole. Moreover, certain of these embodiments may evaluate borehole deformation while inducing radial stresses at the borehole wall. This data may serve to improve the ability of a well-operator to maintain a productive well and make decisions regarding safety, production, completion, and economics of a well.

Referring initially to FIG. 1, there is schematically represented a cross-section of a subterranean formation 10 in which is drilled a borehole 12. The borehole 12 may be used to access geothermal sources, water, hydrocarbons, minerals, etc. and may also be used to provide conduits or passages for equipment such as pipelines. Suspended within the borehole 12 at the bottom end of a non-rigid carrier such as a wireline 14 is a formation evaluation tool 100. The wireline 14 is often carried over a pulley 18 supported by a derrick 20. Wireline deployment and retrieval is performed by a powered winch carried by a service truck 22, for example. A control panel 24 interconnected to the tool 100 through the wireline 14 by conventional means controls transmission of electrical power, data/command signals, and also provides control over operation of the components in the formation evaluation tool 100.

Figure 2:
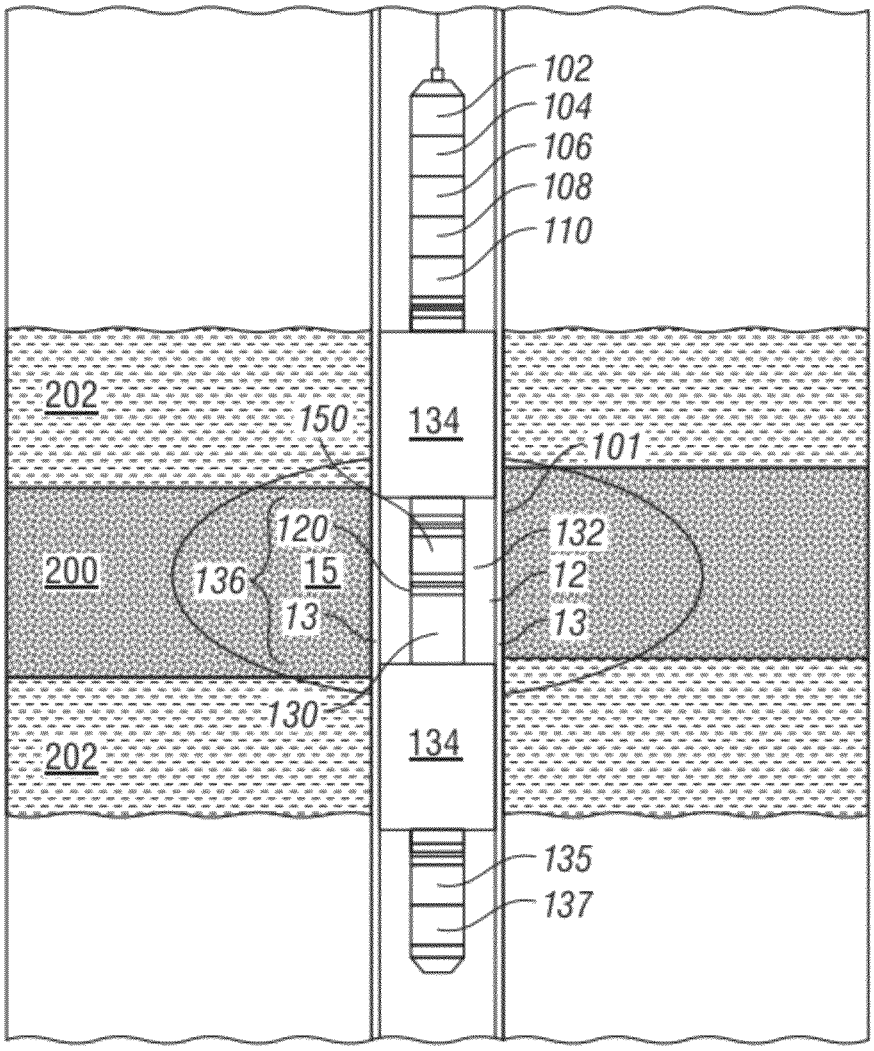
FIG. 2 illustrates a tool according to one embodiment of the disclosure that utilizes, in part, a pressurized fluid to stress a borehole wall.

Referring now to FIG. 2, there is schematically illustrated one embodiment of a formation evaluation tool 100 that can induce stresses in a borehole wall 101 and estimate a response of the borehole wall to the applied stress. As used herein, the term stress refers to an applied force. The tool 100 includes a cable head 102 that connects to the non-rigid carrier 14 such as a wireline, a plurality of modules 104 and 106, an electronics module 108, a hydraulics module 110, and a testing module 120. The testing module 120 may be configured to direct a force onto a borehole wall 101 and estimate, characterize, or otherwise evaluate a response of the borehole wall 101 to the applied force. The hydraulics module 110 provides hydraulic fluid for energizing and operating the testing module 120 and may include pumps, accumulators, and related equipment for furnishing pressurized hydraulic fluid. The electronics module 108 may include suitable circuitry, controllers, processors, memory devices, batteries, etc. to provide downhole control over the sampling operations. The electronics module 108 may also include a bi-directional communication system for transmitting data and command signals to and from the surface. Exemplary equipment in the electronics module 108 may include controllers pre-programmed with instructions, bi-directional data communication equipment such as transceivers, A/D converters and equipment for controlling the transmission of electrical power. It should be appreciated that the tool 100 may be configured as needed to accomplish specific desired operations. For instance, the modules 104 and 106 can be utilized to house additional tools, such as survey tools, formation evaluation tools, reservoir characterization tools, or can be omitted if not needed. Therefore, it should be understood that the configuration of the tool 100 is merely illustrative and not limiting.

The testing module 120 may include a force module 130 to stress the borehole wall 101 and a dimensional measurement tool 150 to estimate one or more dimensional values relating to the borehole 12, including, but not limited to, one of: (i) diameter and (ii) shape. While a few illustrative arrangements are discussed below for these components, it should be understood that various mechanisms and devices may be used for these components.

In one illustrative embodiment, the force module 130 may use a pressurized fluid to stress the borehole wall 101. In this embodiment, the force module 130 uses a pressurized fluid 132 and two or more sealing members 134 that can form an isolated annular zone or section 136. For instance, the sealing members 134 may physically engage the borehole wall 101 to seal the borehole 12 to prevent fluid movement into and out of the zone 136. The sealing members 134 may be any devices, e.g., packers, that can prevent pressurized fluid 132 leakage from one region of the borehole 12 to another. A mud cake 13 may be created around the borehole 12 by the additives of the drilling fluids. In embodiments where the sealing members 134 are inflated using fluids, the hydraulics module 110 may be used to supply such fluid. The hydraulics module 110 may also supply the pressurized fluid for pressurizing the isolated annular zone 136; and, in some cases, a hydraulically induced fracture 15 may occur parallel, along, or oblique to the borehole at the isolated annular zone 136. Additional borehole image devices (such as optical, electric or acoustic devices) 135 may be used to log the induced fracture after the borehole strain test; while passive micro-seismic geophones 137 may record events during the fracturing process in the isolated zone. In other arrangements, a pressurizing fluid, which may be a liquid, a gas, or mixtures thereof, may also be supplied from the surface via a suitable conduit. Also, in some embodiments, a single sealing member may be adequate where another feature, e.g., a borehole bottom, enables the pressurized fluid to be effectively confined and directed to the borehole wall 101. Also, no sealing member may be needed if a suitable isolated region is already present. The force module 130 may be configurable to adjust for different sized (e.g., axial distance) testing regions 200 or may be constructed for use in different size testing regions 200.

Figure 3:
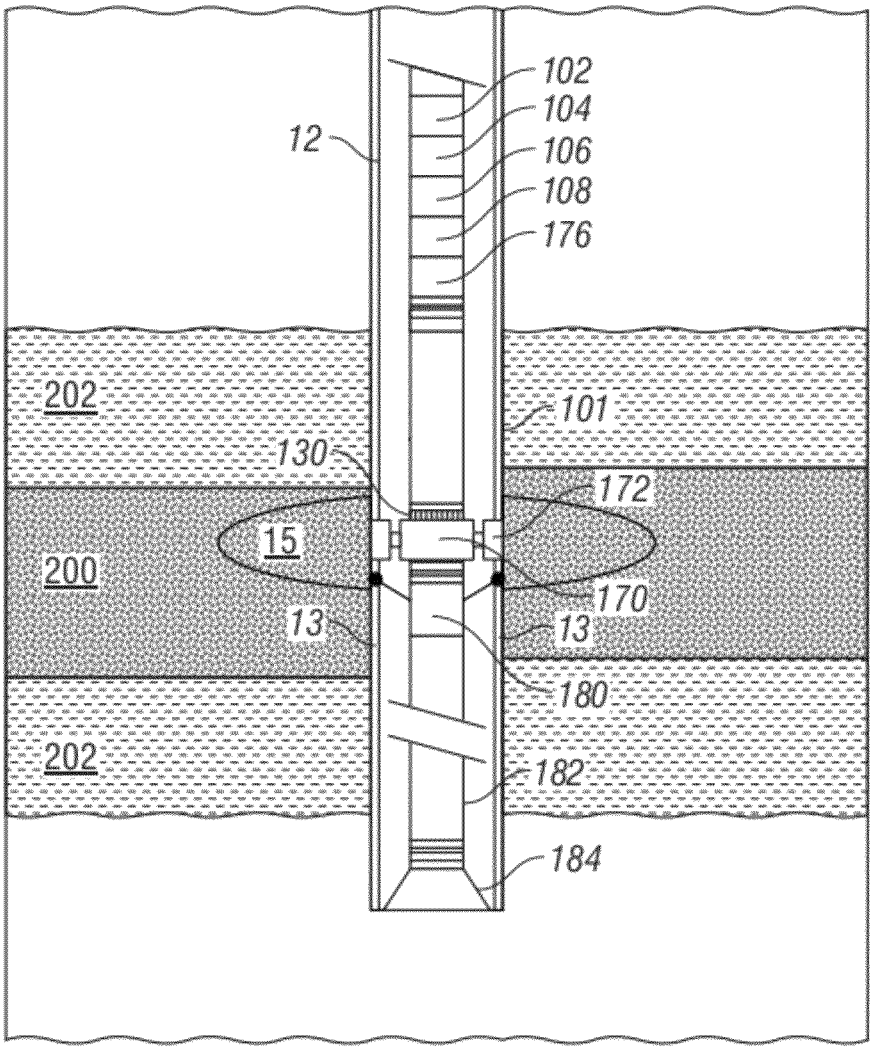
FIG. 3 illustrates a tool according to one embodiment of the disclosure that utilizes, in part, one or more force applicators.

Referring now to FIG. 3, in another illustrative embodiment, the force module 130 may use a mechanically applied force to stress the borehole wall 101. By "mechanical," it is meant that a pad or other suitable member physically contacts the borehole wall 101. In such embodiments, the force module 130 may use an actuator 170 to radially displace one or more force applicators 172 into physical engagement with the borehole wall 101. A hydraulics module (not shown) may supply a pressurized fluid for energizing the actuator 170. Also, the actuator 170 may be electrically energized or use some other suitable energy source. Still other mechanically actuated force applications may include extendable bow device that use a resilient bow that are expanded by magnetic elements and pressurized gas-based devices that extend when a pneumatic fluid supplied thereto. The force applied by the force applicators 172 may be circumferentially balanced along a plane transverse to the long axis of the borehole such that substantially all points along a circumference encounter a similar loading.

Figure 4A:
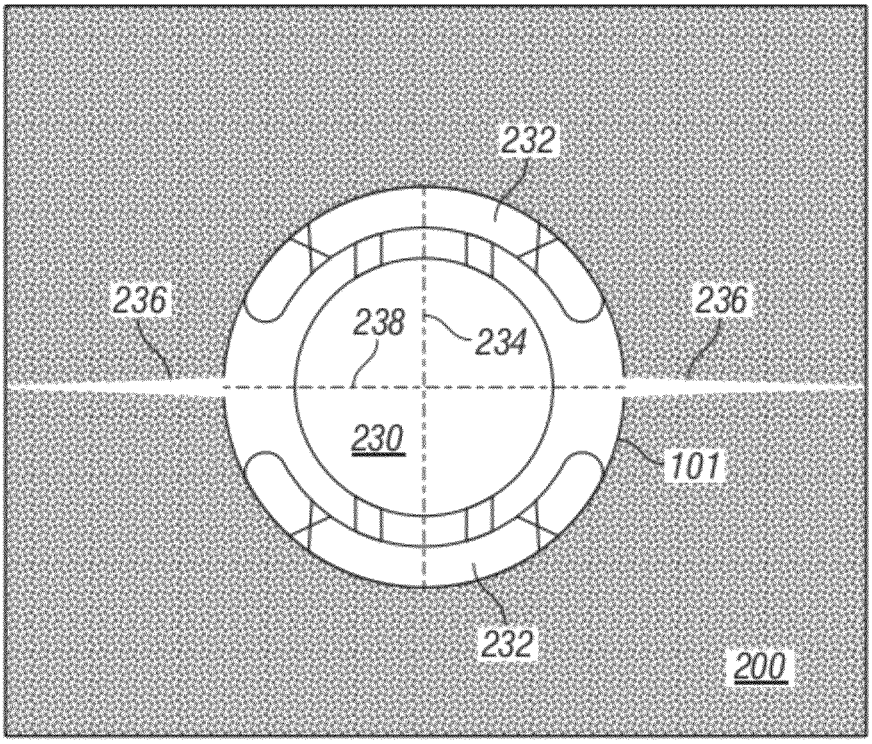
FIG. 4A illustrates an embodiment of the present disclosure that applies a directional force to stress a borehole wall.
Figure 4B:
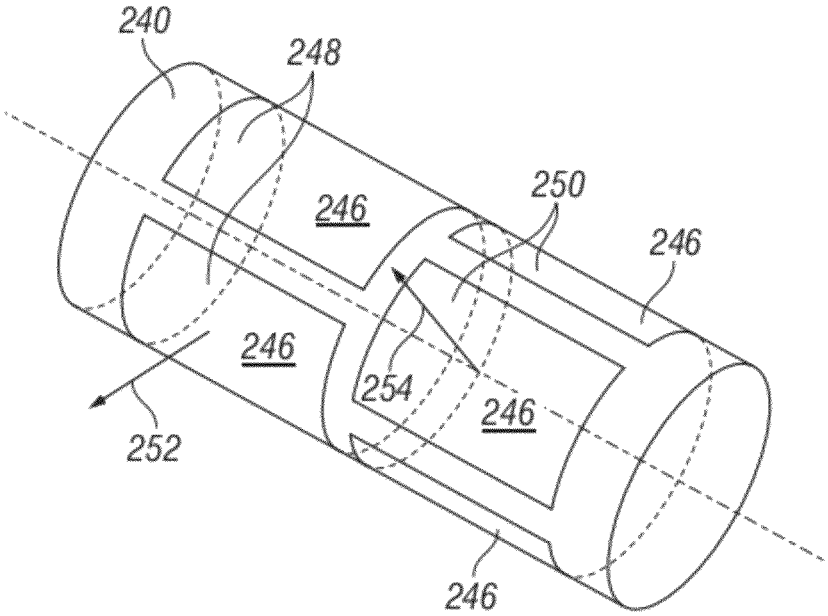
FIG. 4B illustrates an embodiment of the present disclosure that applies a radially distributed force using force applicators to stress a borehole wall.

Referring now to FIGS. 4A and 4B, other stressing regimes may also be utilized using a mechanical force module. In FIG. 4A, there is shown a force module 230 that applies a force using pads 232 along a first axis 234, which may induce micro-fractures 236 along second axis 238. The axes 234 and 238 may be perpendicular to one another, but they also may use a different relative orientation. Thus, rather than a uniformly applied stress, the applied stress by the FIG. 4A embodiment is directional. In certain variants, the applied stress may be in two or more directions. In one embodiment, the pads 232 may be configured to provide a localized loading. In other embodiments, the pads 232 may be configured to engage most of the surface area of the borehole wall 101 both circumferentially and axially. That is, the pads 232 may be axially elongated elements that present an outer contact surface that engages a substantial portion of the exposed borehole wall 101 adjacent to the tool.

In FIG. 4B, there is shown a force module 240 that applies an axially and radially distributed force using a plurality of radially extensible arms 246 that are circumferentially arrayed at two or more axially spaced-apart locations. As shown, a first set 248 of arms is positioned at a first location that is axially separated from a second set 250 of arms at a second location. Additionally, the radial direction of the applied forces may be offset or staggered for the sets 248, 250 of arms. That is, the first set 248 of arms apply forces along axes that may be different from the axes along which the arms of the second set 250 apply forces. For clarity, an illustrative force vector 252 is shown for set 248 and an illustrative radially offset force vector 254 is shown for set 250. During operation, the composite or resultant force applied by the two sets 248, 250 may be a more uniform loading distributed along an axial length of the borehole. While two sets of arms are shown, it should be appreciated that three or more set of arms or force applicators may also be utilized.

Referring now to FIG. 2, in like fashion, numerous technical variants may be utilized for the dimensional measurement tool 150. In embodiments, the dimensional measurement tool 150 may be located between the sealing members 134 of testing module 120 and may measure dimensional changes in the borehole wall 101 as pressure is applied and released by force module 130. In certain arrangements, the dimensional measurement tool 150 may direct an energy wave to the borehole wall 101. One illustrative energy wave may include acoustical waves. For instance, acoustic pulses may be transmitted a transmitter (not shown) in a borehole. A suitable receiver, or the transmitter itself, may detect the reflected acoustical pulses. Time functions representative of travel time of the reflected pulse may then be recorded and processed to estimate a borehole dimension. Also, in some embodiments, electromagnetic energy, which may include electromagnetic waves, may be utilized. Also, in other embodiments, a neutron source and a neutron detector, or other suitable radiation-based system may be utilized to estimate or characterize a borehole dimension or a change in borehole dimensions.

Referring now to FIG. 3, in another illustrative embodiment, a dimensional measurement tool 180 may sense a dimension and/or dimensional change the borehole 12 mechanically using sensitive calipers that make physical contact with borehole wall 101. For example, a multi-finger caliper may be used to measure the response of the borehole wall to induced pressure. The fingers of the caliper may be circumferentially arrayed around the testing module 120 so that the response to induced pressure may be estimated with respect to the direction of the response as well as the magnitude of the response. That is, the responses may be measured along multiple axes. A suitable transducer, such as an LVDT displacement transducer, may be utilized to estimate a movement or displacement of the fingers. In embodiments, several fingers, e.g., twenty or so, may be used to characterize the shape or the change in shape of the borehole 12. However, a suitable caliper may utilize one or more fingers.

Additionally, in embodiments the tool 100 may include a controller 176 to control one or more aspects of the tool operation. The controller 176 may include an information processor (not shown), a data storage medium (not shown), and other suitable circuitry for storing and implementing computer programs and instructions. The data storage medium may be any standard computer data storage device, such as a USB drive, memory stick, hard disk, removable RAM, or other commonly used memory storage system known to one of ordinary skill in the art including Internet based storage. The data storage medium may stores a program and data collected during the testing process. The controller 176 may be programmed to write the acquired measurement data to memory and/or transmit the data to a surface location in real time.

The use of a tool to measure dimensional changes is illustrative and exemplary only, as embodiments of this disclosure may measure other types of responses of the borehole wall to applied pressure, such as changes in temperature, resistivity, and electromagnetic radiation. Additionally, embodiments of the present disclosure may also be deployed in conjunction with a drilling system. For example, as shown in FIG. 3, the tool 100 may be positioned along a drill string 182 having a drill bit 184. Still further, it should be understood that the features shown in the Figures are susceptible to numerous combinations. For instance, the mechanical caliper of FIG. 3 may be used with the pressurized fluid force module of FIG. 2.

Referring now to FIGS. 1, 2 and 3, one method of deploying the tool 100 includes first characterizing a subsurface formation or formation of interest 200 in order to identify a suitable location for setting the tool 100. One aspect of a suitable location may include the locating of a formation interval 200 or layer having a rock strength less than adjacent layers or a fracture gradient profile that provides sufficient stress contrast between the zone 136 and the sub-and-supra adjacent formation layers 202. In some applications, a suitable location includes a first layer 200 interposed between two layers 202 that have a relatively higher fracture pressure than the first layer 200. Thus, a greater pressure is required to fracture the layers 202 than the layer 200. Once a suitable location has been identified, the tool 100 may be conveyed into the well and the sealing members 134 may be actuated to engage and form a seal with the second layers 202. For example, the hydraulic unit 110 may pump fluid into the sealing members 134. Upon the isolated zone 136 being formed, a pressurized fluid 132 is directed into the isolated zone 136. In arrangements, the pressure in the sealing members 134 is approximately the same as that of the pressurized fluid, which minimizes fluid flux across the sealing members 134. The controller 176 may be programmed to control one or more of these tasks.

In one testing mode, fluid pressure is periodically or continuously measured as pressure is increased in the zone 136. The pressure in the isolated zone 136 may be measured by a suitable sensor (not shown) in the hydraulic unit 110 or elsewhere and recorded in the electronics module 108. Such a task may be executed by the controller 176. At some point, the fluid pressure in the zone 136 will initiate micro-fractures in the borehole wall 101. This point may be discernable by optical, electric, or acoustic images taken of the borehole wall 101 by suitable logging equipment 135. Also, the micro-fractures may be detected by a loss of fluid into the layer 200, which may result in a drop in fluid pressure. It should be noted that the micro-fractures will occur in the layer 200 rather than the adjacent layers 202, because the adjacent layers 202 have a higher fracture pressure. After the micro-fractures occur, the fluid pressure may be lowered until the micro-fractures close, which may result in stabilization in fluid pressure because the flow of fluid into the layer 200 has stopped. This process of initiating and closing micro-fractures may be cycled as needed. In another embodiment, measurements may be taken at specific points in time, or only during pressurization or depressurization of the fluid.

Figure 5B:
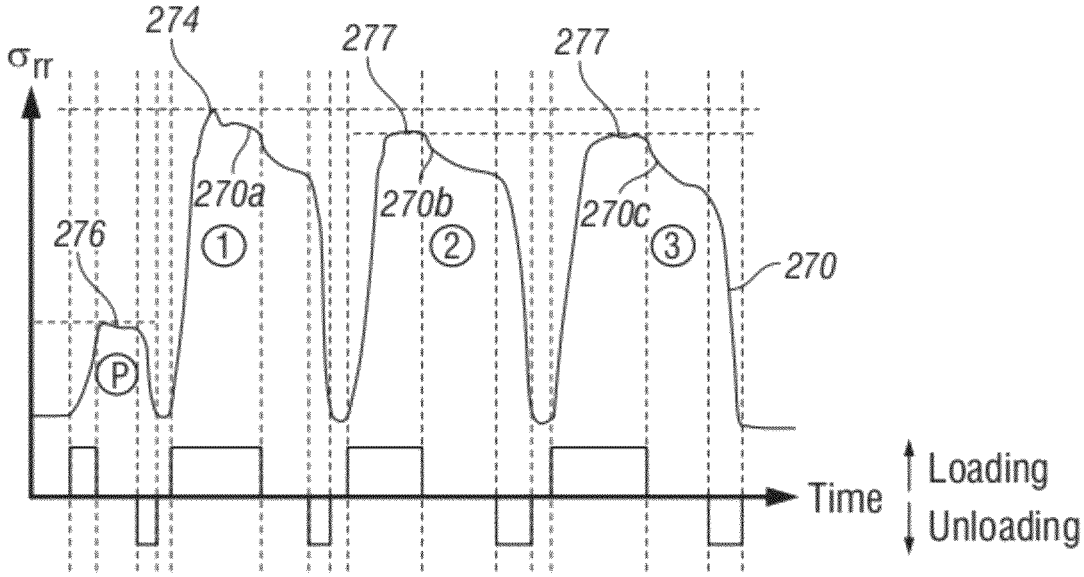
FIG. 5B is another graph of a change in borehole radial stress versus time that may be obtained using embodiments of the present disclosure.
Figure 5A:
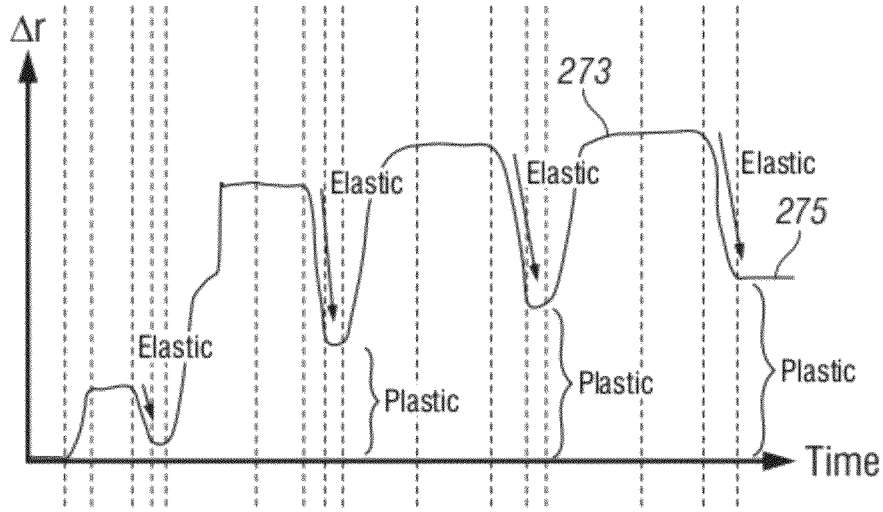
FIG. 5A is a graph of a change in borehole radius versus time that may be obtained using embodiments of the present disclosure.

During the increase and decrease of pressure during testing, the dimensional measurement device 150/180 may detect changes in the borehole wall 101. The change may be a change in dimension along one axis or along multiple axes. The dimensions and/or changes in dimension of the borehole 12 may be recorded with respect to time and correlated with the pressure or loading force data. The pressure/loading data, deformation (strain) data and/or other acquired data may be written to memory and/or transmitted to the surface. In one arrangement, the pressure data and the borehole deformation data may be used to estimate strain data for the borehole wall 101. Also, strain may be elastic or plastic in nature, as shown in FIG. 5A as the change in borehole radius versus time. Thus, this data may be analyzed to identify the degree of elastic strain and the plastic characteristics of the borehole due to change of induced stresses. That is, the data collected may be used to identify a plastic region and/or an elastic region for the mechanical behavior of the formation 200. Referring now to FIG. 5B, there is shown an illustrative graph showing a change of borehole radial stresses versus time that may be generated by utilizing embodiments of the present disclosure. The radial stress acting in the borehole wall may be measured by the pressure in the isolated interval when the stresses are induced hydraulically, while the radial stresses may be obtained by measuring the radial loading forces acting on the borehole when the borehole induced stresses are created mechanically by radially extensible arms 246. The curve 270 shows three pressure/loading cycles 270*a*, 270*b*, 270*c* wherein a borehole wall deformation is characterized as a change in borehole radius illustrated in curve 273 of FIG. 5A. A maximum radial loading stress/pressure is shown at peak 274. The peak 274 may be associated with a fracture initiation pressure of the borehole wall, also known as, formation breakdown pressure. Subsequent to the reduction of applied stress, the radial deformation does not return to zero because the borehole has been permanently deformed. That is, the borehole has undergone both a plastic and an elastic deformation. The final plastic deformation is shown with numeral 275 on the curve 273. It should be appreciated that pressure data may also be associated with the borehole deformation data in a similar manner. A pre-consolidation test may be performed initially around the borehole up to ¼ of the expected formation breakdown 274; this pre-test is shown as 276 over the curve 270. Subsequent repeated loading cycles after formation breakdown 274 could be performed to verify fracture re-opening stress/pressure 277.

Figure 5C:
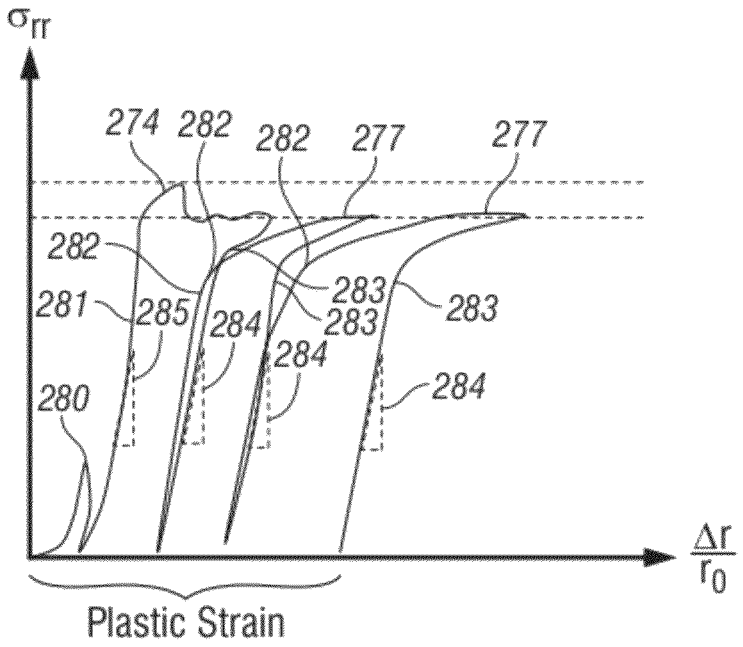
FIG. 5C is a graph of a change in borehole radial stress versus radial strain showing formation stiffness and plasticity characteristics that may be obtained using embodiments of the present disclosure.

It should be appreciated that by measuring the borehole deformation during loading and unloading cycles, formation stiffness and plasticity may be measured directly at in-situ conditions by radially acting borehole stress versus radial borehole strain, shown in FIG. 5C. Thus, elastic or plastic properties of the formation may be estimated directly. These measurements may identify when the rock in the layer 200 may breakdown by brittle or ductile failure. These measurements may further help to characterize ductile formations such as salt, silt, some shale, and poorly consolidate sandstones. Referring to FIG. 5C, the pre-test borehole consolidation is show in loading cycle 280 over the curve 281. Also, the formation breakdown 274 and the fracture propagation 279 after fracture reopening 282 may be observed in this graph during the subsequent loading/unloading cycles. The fracture reopening stress 282 and fracture closure stress 283 may be observed as inflection points of the curve 281 during loading and unloading stress path, and they may not coincide during the first two cycles. The fracture closure stress should slightly decrease as repeated cycles are performed until the borehole induced stresses are almost negligible with respect to the in-situ formation stress as the fracture 15 propagates away from the borehole. The stiffness 284 of the formation 200 could be directly measured by the slope of the curve 281 during unloading path and after fracture closure 283. Alternatively, the stiffness 285 of the rock could be also measured during loading cycles before fracture opening. The stiffness of the rock could be compared during loading and unloading as multiple cycles are performed. It is expected to see increase of rock stiffness as more plastic strain in consumed on previous cycles. These plastic characteristic of rocks will define the mechanical behavior of plastic formations under stress loading/unloading cycles at in-situ conditions.

Figure 5D:
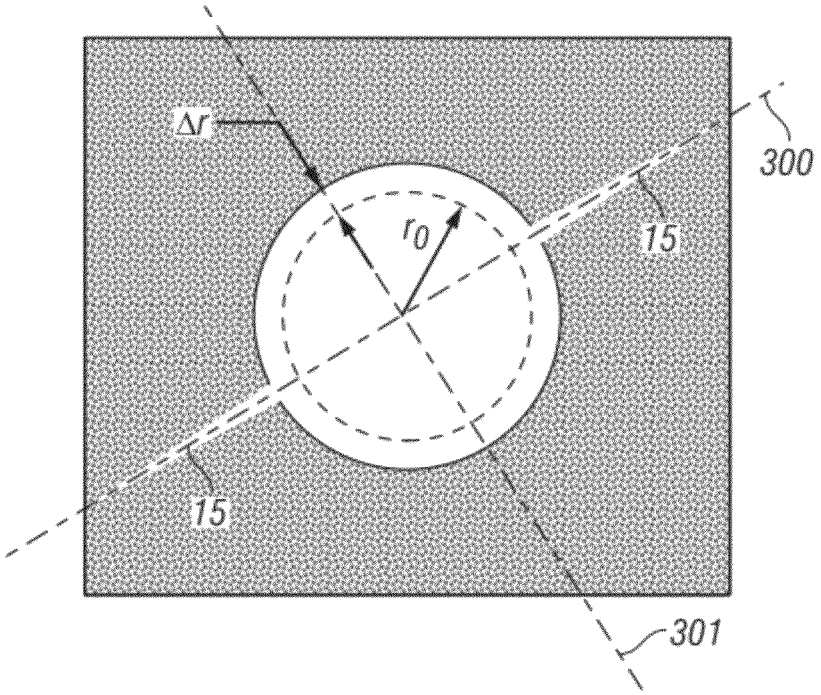
FIG. 5D is a schematic of fracture propagation in a formation that may be obtained using embodiments of the present disclosure.

Additionally, the borehole deformation orientation may be measured by obtaining tool orientation information using a suitable device that provides orientation data (e.g., azimuth, borehole highside, magnetic north, true north, etc.). Orientation data, together with dimensional change or radial deformation data, may be used to estimate borehole ovalization, i.e., determination of the direction of specific stresses (e.g., maximum stress) that can deform the wall of the borehole. Borehole ovalization may be used, in turn, to estimate the orientation and magnitude of the horizontal stresses in vertical boreholes. Furthermore, the direction of the maximum radial strain during stress loading and after fracture opening could be used for determining the fracture 15 orientation. The FIG. 5D shows how the direction of fracture propagation 300 should be perpendicular to the direction of the maximum radial borehole strain 301 during stress loading and after fracture opening when a single induced fracture is created in the borehole.

Figure 6:
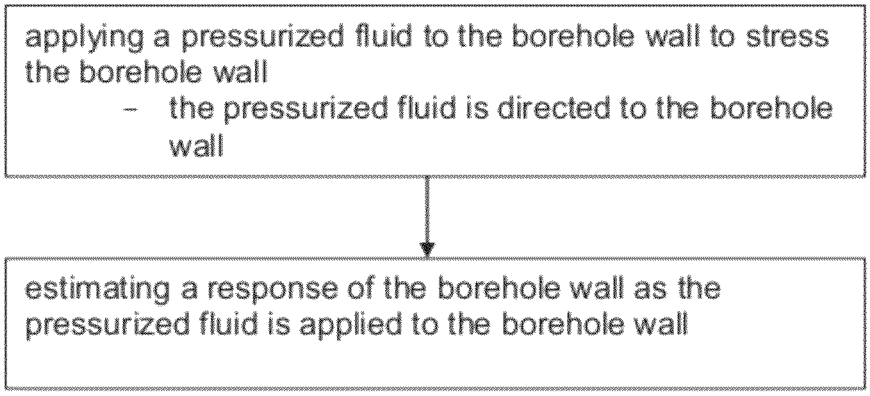
FIG. 6 illustrates one embodiment of a method for estimating a response relating to a formation according to the present disclosure.

As shown above, one embodiment of the disclosure includes a method for estimating a response relating to a formation, comprising: stressing a wall of a borehole formed in the formation by either: flowing a fluid into the borehole to induce the stress or actuating a force application to engage the borehole wall to induce the stress, wherein the amount of stress is below an amount of stress that fractures the borehole wall; estimating a dimensional change of the borehole wall to the stress with ultra-sensitive multi-finger calipers or strain gauges assembled in the tool, wherein the dimensional change is estimated continuously using at least one of: (i) at least one extensible member configured to contact the wellbore wall, (ii) an acoustic source, (iii) a laser source, and (iv) a strain gauge; and estimating the at least one parameter of interest based on the estimated dimensional change, and wherein the dimensional change is due to a elastic and plastic deformation of the borehole wall by loading and unloading stresses on the borehole while measuring the radial borehole deformation. One embodiment of a method for estimating a response relating to a formation according to the present disclosure is illustrated in the FIG. 6 flow chart. As depicted, the FIG. 6 flow chart includes the step of applying a pressurized fluid to the borehole wall to stress the borehole wall, wherein the pressurized fluid is directed to the borehole wall and estimating a response of the borehole wall as the pressurized fluid is applied to the borehole wall.

Another embodiment of the disclosure includes an apparatus for estimating at least one parameter of interest relating to a formation, comprising: a force module configured to induce a stress in a formation around a borehole formed in the formation by either applying a pressurized fluid to the formation or engaging the formation with at least one force application member; a tool, comprising a caliper or a strain gauge, configured to estimate a dimensional change in the formation to the induced stress, wherein the tool includes at least one of: (i) at least one extensible member configured to contact the wellbore wall, (ii) an acoustic source, (iii) a laser source, and (iv) a strain gauge; a first borehole sealing device and a second borehole sealing device, wherein the tool is interposed between the first and the second borehole sealing devices; and an information processing device that is programmed to estimate the at least one parameter of interest using an output of the tool.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. Thus, it is intended that the following claims be interpreted to embrace all such modifications and changes.

What is claimed is:

1. A method for estimating a response relating to a formation, comprising:

applying a pressurized fluid to a wall of a borehole to stress the borehole wall using a force module disposed in the borehole, wherein the force module directs the pressurized fluid to the borehole wall; and estimating a response of the borehole wall to the stress as the force module applies the pressurized fluid to the borehole wall.

2. The method of claim 1, wherein the response is a dimensional change.

3. The method of claim 1 further comprising:

estimating a strain based on the response.

4. The method of claim 1, wherein the amount of stress is below an amount of stress that fractures the borehole wall.

5. The method of claim 1, further comprising:

estimating at least one parameter of interest based on the estimated response.

6. The method of claim 1, wherein response of the borehole is estimated using an energy wave.

7. The method of claim 1, wherein the response is estimated continuously.

8. The method of claim 1, wherein the response is a change in at least one of (i) borehole diameter and (ii) borehole shape.

9. The method of claim 1, further comprising estimating a mechanical behavior of the formation using the estimated response.

10. The method of claim 1, further comprising estimating borehole deformation orientation.

11. An apparatus for estimating a response relating to a formation, comprising:

a force module configured to be conveyed into a borehole and to apply a pressurized fluid to a wall of the borehole to stress the borehole wall, the force module being further configured to direct the pressurized fluid to the borehole wall; and a tool configured to estimate a response of the borehole wall to the stress as the pressurized fluid is applied to the borehole wall.

12. The apparatus of claim 11, wherein the response is a dimensional change.

13. The apparatus of claim 11, wherein the tool is configured to emit an energy wave.

14. The apparatus of claim 11, wherein the tool is configured to detect energy.

15. The apparatus of claim 11, further comprising:

an information processing device programmed to estimate at least on parameter of interest using and output of the tool.

16. The apparatus of claim 11, wherein the tool estimates a change in at least one of (i) borehole diameter and (ii) borehole shape.

17. The apparatus of claim 11, wherein the tool includes a caliper.

18. The apparatus of claim 17, wherein the caliper includes at least one of: (i) at least one extensible member configured to contact the borehole wall; (ii) an acoustic source; (iii) a laser source; and (iv) a strain gauge.

19. The apparatus of claim 11, further comprising:

a first borehole sealing device; and a second borehole sealing device, wherein the tool is interposed between the first wellbore sealing device and the second borehole sealing device.

20. The apparatus of claim 19, wherein the force module is configured to direct the pressurized fluid into a space separating the first borehole sealing device and the second borehole sealing device.

* * * * *